US010184477B2

(12) United States Patent
Chang et al.

(10) Patent No.: US 10,184,477 B2
(45) Date of Patent: Jan. 22, 2019

(54) SERIES FAN INCLINATION STRUCTURE

(71) Applicant: ASIA VITAL COMPONENTS CO., LTD., New Taipei (TW)

(72) Inventors: Bor-Haw Chang, New Taipei (TW); Yu-Tzu Chen, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 15/368,702

(22) Filed: Dec. 5, 2016

(65) Prior Publication Data

US 2018/0156222 A1 Jun. 7, 2018

(51) Int. Cl.

| | |
|---|---|
| ***F04D 19/00*** | (2006.01) |
| ***F04D 25/08*** | (2006.01) |
| ***F04D 25/16*** | (2006.01) |
| ***F04D 29/66*** | (2006.01) |

(52) U.S. Cl.

CPC ..... *F04D 19/007* (2013.01); *F04D 25/08* (2013.01); *F04D 25/166* (2013.01); *F04D 29/665* (2013.01)

(58) Field of Classification Search

CPC . G06F 1/181–1/182; H05K 7/20218–7/20381; H05K 7/20409–7/20418; H05K 7/20009–7/202; H01L 23/367–23/3677; H01L 23/473; H01L 23/46–23/467

USPC ..... 361/676–678, 679.46–679.54, 688–723, 361/699–704, 709–710, 719–721; 165/80.1–80.5, 104.33, 185; 174/15.1–15.3, 16.1–16.3, 547, 548; 257/712–722, E23.088; 24/453, 458–459; 454/184; 312/236

See application file for complete search history.

(56) References Cited

U.S. PATENT DOCUMENTS

| | | | | |
|---|---|---|---|---|
| 5,244,347 | A * | 9/1993 | Gallivan | F04D 29/325 415/208.2 |
| 5,544,012 | A * | 8/1996 | Koike | H05K 7/20572 165/122 |
| 5,796,580 | A * | 8/1998 | Komatsu | H05K 7/20727 361/679.47 |
| 5,880,932 | A * | 3/1999 | Jelinger | G06F 1/26 307/150 |
| 6,061,237 | A * | 5/2000 | Sands | G06F 1/20 164/121 |
| 6,183,214 | B1 * | 2/2001 | Ko | F04D 29/601 361/695 |

(Continued)

*Primary Examiner* — Robert J Hoffberg
*Assistant Examiner* — Razmeen Gafur
(74) *Attorney, Agent, or Firm* — Jackson IPG PLLC; Demian K. Jackson

(57) ABSTRACT

A series fan inclination structure includes an inclined frame body assembly, a first rotor assembly and a second rotor assembly. The inclined frame body assembly has a receiving space. The receiving space includes a first space, a second space and a flow guide passage. A first base seat is obliquely disposed in the first space. A second base seat is obliquely disposed in the second space. The flow guide passage is formed between the first and second base seats in communication with the first and second spaces. The first and second rotor assemblies are correspondingly rotatably disposed on the first and second base seats. The series fan inclination structure is able to greatly reduce the vibration and lower the noise caused by the interaction of the dipole.

10 Claims, 10 Drawing Sheets

(56) References Cited

U.S. PATENT DOCUMENTS 6,315,656 B1 * 11/2001 Pawlowski ..... H02B 1/565 361/695
6,481,527 B1 * 11/2002 French ..... G10K 11/16 181/198
6,512,673 B1 * 1/2003 Wiley ..... G06F 1/183 165/185
6,537,019 B1 * 3/2003 Dent ..... F04D 25/166 361/679.48
7,238,104 B1 * 7/2007 Greenslade ..... G06F 1/20 361/695
7,626,819 B1 * 12/2009 Chen ..... G06F 1/20 361/694
7,771,165 B2 * 8/2010 Chen ..... F04D 29/601 174/252
7,824,155 B2 * 11/2010 Chen ..... F04D 29/601 361/695
7,990,700 B2 * 8/2011 Guo ..... G06F 1/20 165/121
8,047,803 B2 * 11/2011 Yamada ..... H05K 7/20172 361/695
8,100,674 B2 * 1/2012 Lin ..... H05K 7/20172 361/697
8,177,486 B2 * 5/2012 Lee ..... H05K 7/20172 415/213.1
8,757,970 B2 * 6/2014 Hsu ..... F04D 25/166 415/213.1
8,817,470 B2 * 8/2014 Aoki ..... H05K 7/20727 312/236
2002/0018337 A1 * 2/2002 Nakamura ..... G06F 1/1616 361/697
2002/0075647 A1 * 6/2002 DiFonzo ..... G06F 1/1616 361/679.48
2002/0153371 A1 * 10/2002 Oshima ..... H05B 6/642 219/757
2003/0198018 A1 * 10/2003 Cipolla ..... G06F 9/52 361/679.48
2005/0052843 A1 * 3/2005 Baker ..... G06F 1/20 361/679.47
2005/0260065 A1 * 11/2005 Kikuichi ..... F04D 25/166 415/60
2006/0039110 A1 * 2/2006 Foster, Sr. ..... F04D 19/007 361/697
2006/0268514 A1 * 11/2006 Fan ..... H05K 7/20172 361/695
2007/0047200 A1 * 3/2007 Huang ..... G06F 1/20 361/695
2007/0109743 A1 * 5/2007 Sugimoto ..... F01D 5/186 361/689
2007/0158053 A1 * 7/2007 Nicolai ..... F24F 5/00 165/122
2008/0053639 A1 * 3/2008 Lin ..... H05K 7/20172 165/80.3
2008/0101021 A1 * 5/2008 Sanchez ..... F04D 25/0613 361/695
2008/0218446 A1 * 9/2008 Yamanaka ..... H05K 7/20972 345/60
2008/0314555 A1 * 12/2008 Wu ..... F28D 15/0266 165/80.3
2009/0022587 A1 * 1/2009 Yoshida ..... F04D 19/007 415/213.1
2009/0139691 A1 * 6/2009 Wei ..... G06F 1/20 165/80.3
2009/0230201 A1 * 9/2009 Na ..... G05D 23/19 236/49.3
2010/0027215 A1 * 2/2010 Wu ..... G06F 1/20 361/679.48
2010/0073873 A1 * 3/2010 Horng ..... F04D 29/526 361/695
2010/0107397 A1 * 5/2010 Letourneau ..... H05K 7/20172 29/453
2010/0149753 A1 * 6/2010 Lin ..... G06F 1/20 361/695
2010/0296237 A1 * 11/2010 Guo ..... G06F 1/184 361/679.48
2011/0149513 A1 * 6/2011 Silvennoinen ..... H05K 7/20172 361/695
2011/0255245 A1 * 10/2011 Cheng ..... G06F 1/203 361/695
2011/0292604 A1 * 12/2011 Janes ..... H05K 7/20909 361/695
2012/0009059 A1 * 1/2012 Okamoto ..... B60H 1/00471 415/224
2012/0026678 A1 * 2/2012 Rodriguez ..... G06F 1/20 361/679.48
2012/0045325 A1 * 2/2012 Horng ..... F04D 25/0606 415/220
2012/0057973 A1 * 3/2012 Chen ..... F04D 25/0613 415/213.1
2012/0113593 A1 * 5/2012 Hsu ..... G06F 1/203 361/696
2012/0171057 A1 * 7/2012 Wu ..... F04D 19/007 417/354
2012/0183396 A1 * 7/2012 Feng ..... F04D 25/0613 415/213.1
2012/0201003 A1 * 8/2012 Shimasaki ..... H05K 7/20736 361/695
2013/0070409 A1 * 3/2013 Hoss ..... G06F 1/20 361/679.31
2013/0070417 A1 * 3/2013 Du ..... G06F 1/20 361/695
2013/0168064 A1 * 7/2013 Akiyoshi ..... F24F 1/0011 165/121
2013/0229774 A1 * 9/2013 Chen ..... H05K 7/20136 361/695
2014/0118926 A1 * 5/2014 Santos ..... G06F 1/206 361/679.48
2014/0118937 A1 * 5/2014 Adrian ..... H05K 7/20172 361/695
2014/0233185 A1 * 8/2014 Wen ..... H05K 7/20172 361/695
2015/0086351 A1 * 3/2015 Chang ..... F04D 29/601 415/213.1
2015/0354598 A1 * 12/2015 Dygert ..... F04D 29/164 415/208.2
2016/0381836 A1 * 12/2016 Hall ..... H05K 7/20718 361/679.48
2018/0028407 A1 * 2/2018 Omura ..... A61J 7/0076
2018/0135650 A1 * 5/2018 Chang ..... F04D 19/007

* cited by examiner

SERIES FAN INCLINATION STRUCTURE

BACKGROUND OF THE INVENTION

1. Field of the Invention

The present invention relates generally to a series fan inclination structure, and more particularly to a series fan inclination structure, which can greatly reduce the vibration and lower the noise.

2. Description of the Related Art

Along with the continuous advance of science and technologies, the dependence of peoples on various electronic apparatuses has more and more increased. In operation, the internal components of the electronic products (such as computers and notebooks) will generate high heat. The heat generated by the internal components must be conducted outside the electronic product in time. Otherwise, the electronic product will overheat. In general, a fan is disposed in the electronic product to dissipate the heat and keep the electronic product operating at an operation temperature within a certain range.

Please refer to FIGS. 1A and 1B. In a conventional series fan 1, the fan frames 10 are mated and serially connected with each other. With respect to the heat dissipation of a large-scale apparatus, sometimes multiple series fans are further combined in parallel and co-used. When the series fan 1 operates, on the design principle of the motor torque operation, the fan 1 will inevitably vibrate, especially in the case that more than two series fans 1 are combined in parallel and co-used. The parallel combination of the series fans 1 is able to increase the air volume so as to effectively exhaust the heat from the interior of the electronic product. However, when all the series fans 1 simultaneously operate, under the inter-affection of the ground-state vibration frequency of the fan impellers 11 of the fans 1, the fan frames 10 will severely resonate. The series fans 1 are combined in parallel so that the pairs of fans will interact on each other to synergize the development of the noise dipole. This will make loud noise.

According to the above, the conventional series fan has the following shortcomings:

1. The vibration of the fan is more serious.
2. Due to the development and interaction of the dipole, the fan will make loud noise.

It is therefore tried by the applicant to provide a series fan inclination structure to solve the above problems of the conventional series fan.

SUMMARY OF THE INVENTION

It is therefore a primary object of the present invention to provide a series fan inclination structure, which can greatly reduce the vibration.

It is a further object of the present invention to provide a series fan inclination structure, which can destruct the interaction of the noise dipole so as to lower the noise.

To achieve the above and other objects, the series fan inclination structure of the present invention includes an inclined frame body assembly, a first rotor assembly and a second rotor assembly. The inclined frame body assembly has a receiving space. The receiving space includes a first space, a second space and a flow guide passage. A first base seat is obliquely disposed in the first space. A second base seat is obliquely disposed in the second space. The flow guide passage is formed between the first and second base seats in communication with the first and second spaces. The first rotor assembly is correspondingly disposed on the first base seat. The first rotor assembly has a first shaft and multiple first blades. One end of the first shaft is rotatably disposed on the first base seat. The second rotor assembly is correspondingly disposed on the second base seat. The second rotor assembly has a second shaft and multiple second blades. One end of the second shaft is rotatably disposed on the second base seat.

In the above series fan inclination structure, the inclined frame body assembly has a horizontal axis. The horizontal axis and outer wall of the inclined frame body assembly contain a first angle. The inclined frame body assembly has a first vertical axis. The first vertical axis and the first base seat contain a second angle. The inclined frame body assembly has a second vertical axis. The second vertical axis and the second base seat contain a third angle. In other words, the inclined frame body assembly has an inclined configuration and the first and second base seats are obliquely disposed on the inner wall of the inclined frame body assembly. Therefore, the first and second rotor assemblies are also rotatably disposed on the first and second base seats in an inclined state. Accordingly, the entire series fan has an inclined structure. In this case, the flow direction and pattern of the airflow entering the series fan structure are changed and the development of audio frequency of the dipole is destructed. This solves the problem of the conventional series fan that when multiple series fans are combined in parallel and co-used, the pairs of fans will interact on each other to synergize the development of the noise dipole and cause great vibration and make loud noise. Therefore, the present invention can greatly lower the noise.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
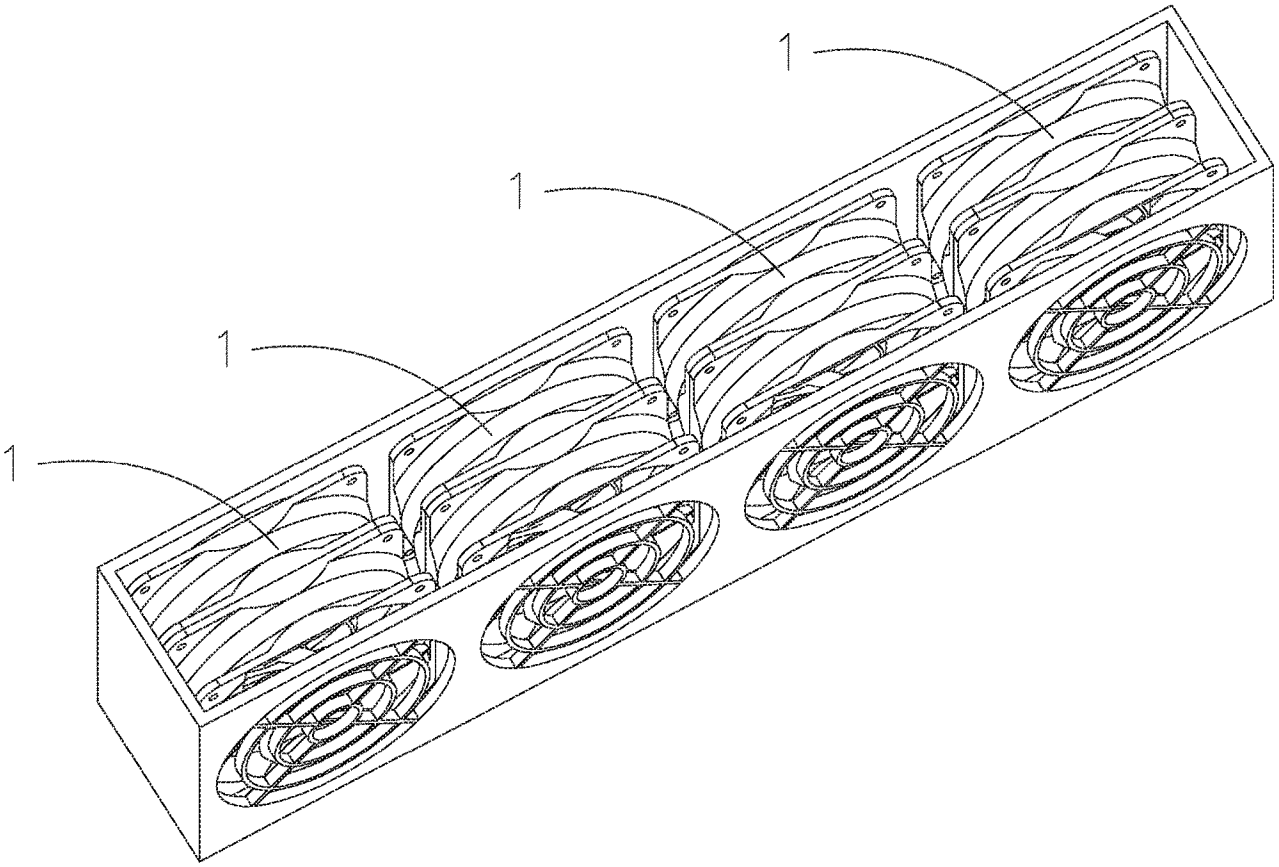
FIG. 1A is a perspective view of a conventional series fan structure.
Figure 1B:
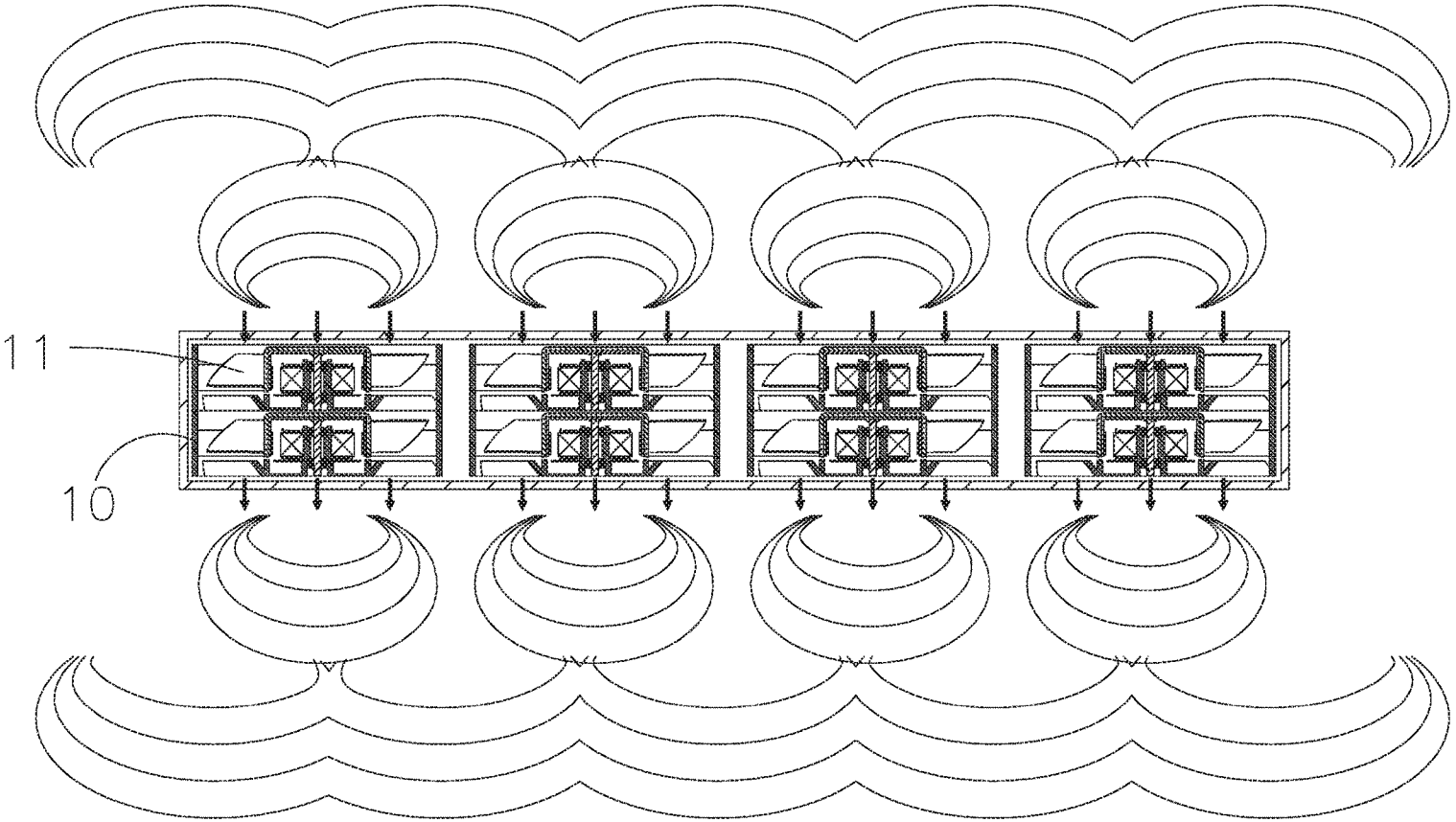
FIG. 1B is a sectional assembled view of the conventional series fan structure.
Figure 2:
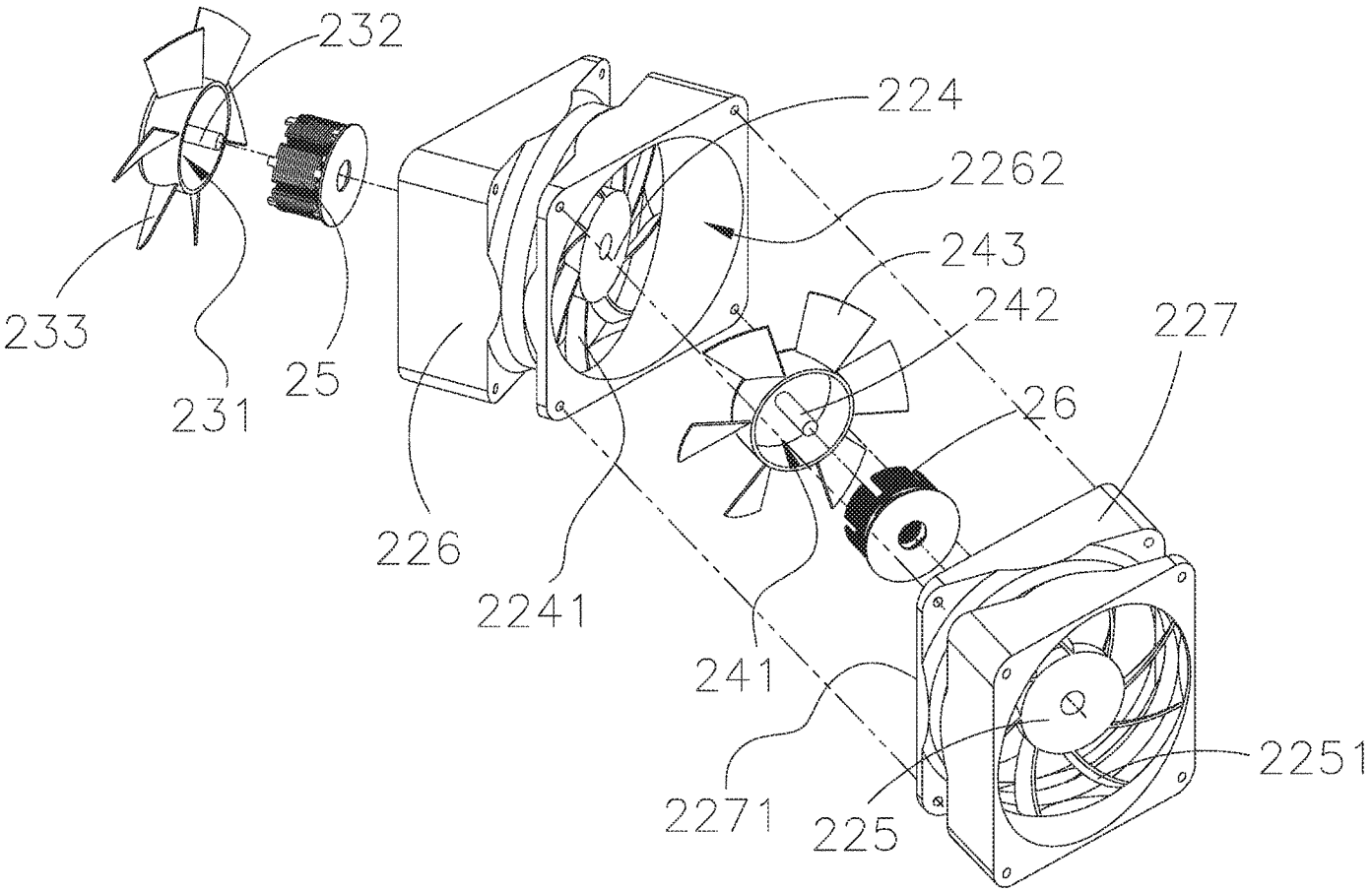
FIG. 2 is a perspective exploded view of a first embodiment of the series fan inclination structure of the present invention.
Figure 3:
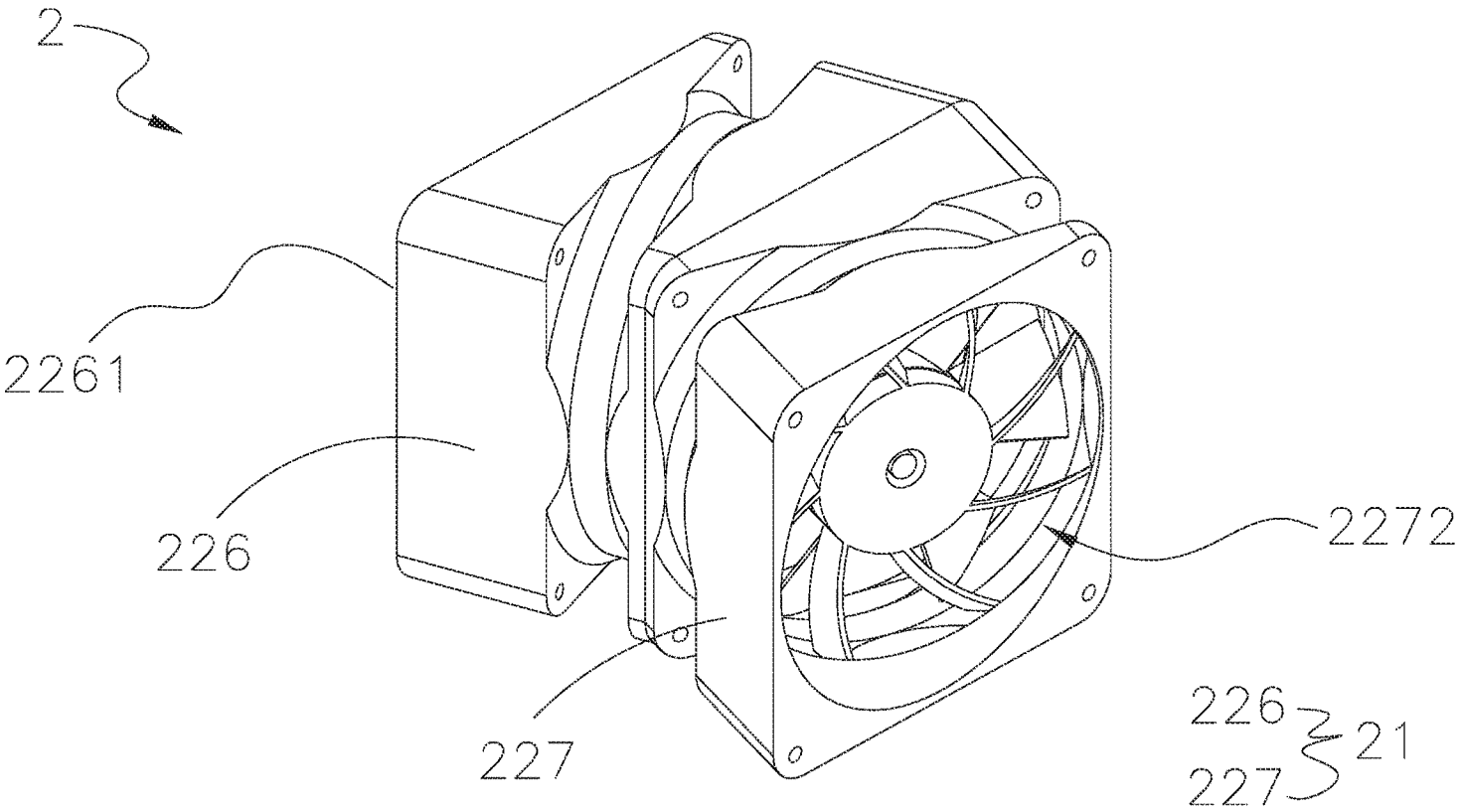
FIG. 3 is a perspective assembled view of the first embodiment of the series fan inclination structure of the present invention.
Figure 4:
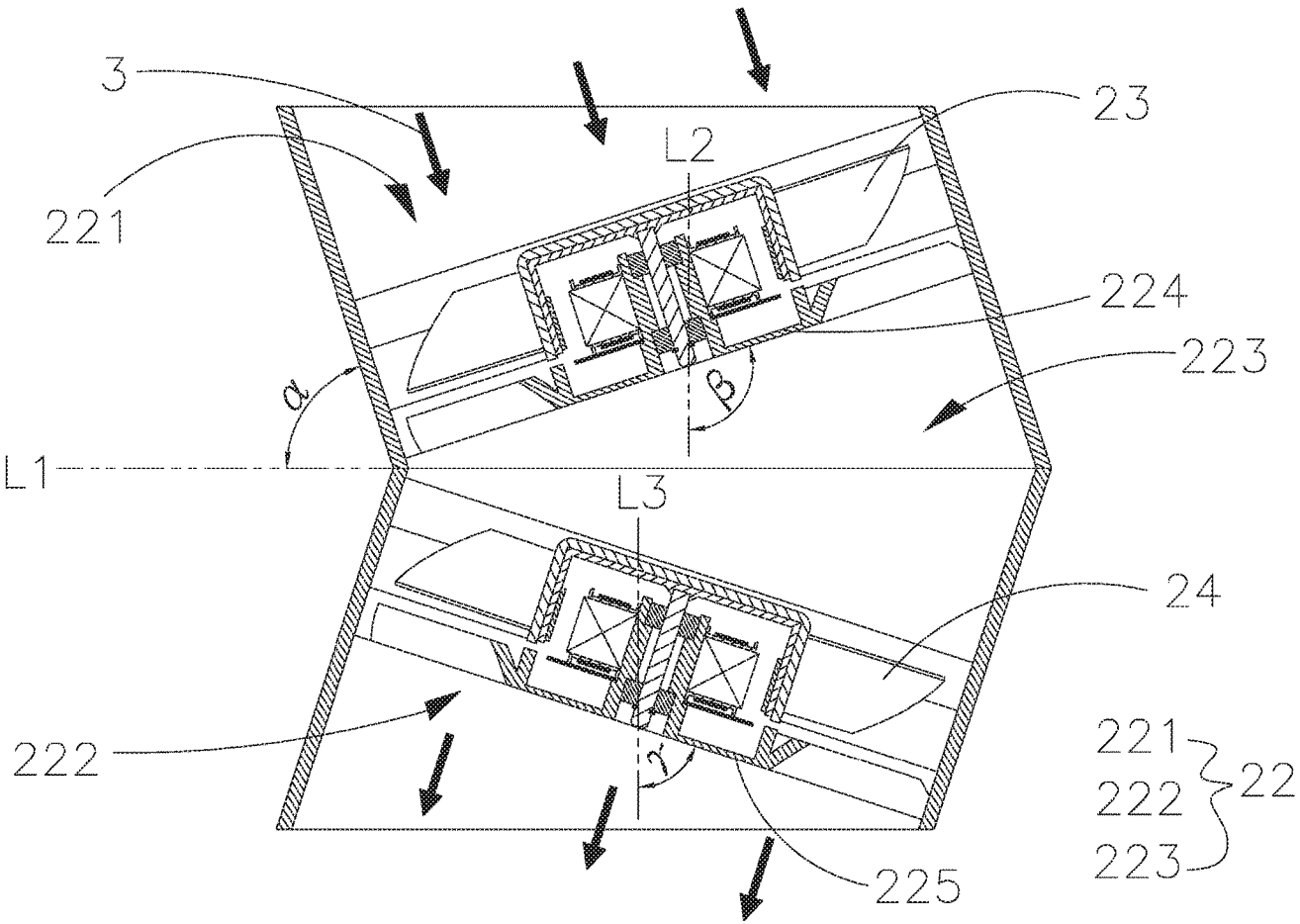
FIG. 4 is a sectional view of the first embodiment of the series fan inclination structure of the present invention.

Please refer to FIGS. 2, 3 and 4. FIG. 2 is a perspective exploded view of a first embodiment of the series fan inclination structure of the present invention. FIG. 3 is a perspective assembled view of the first embodiment of the series fan inclination structure of the present invention. FIG. 4 is a sectional view of the first embodiment of the series fan inclination structure of the present invention. According to the first embodiment, the series fan inclination structure 2 of the present invention includes an inclined frame body assembly 21, a first rotor assembly 23 and a second rotor assembly 24. The inclined frame body assembly 21 has a receiving space 22. The receiving space 22 includes a first space 221, a second space 222 and a flow guide passage 223. A first base seat 224 is obliquely disposed in the first space 221. A second base seat 225 is obliquely disposed in the second space 222. The flow guide passage 223 is formed between the first and second base seats 224, 225 in communication with the first and second spaces 221, 222. The first base seat 224 has multiple first support sections 2241. The second base seat 225 has multiple second support sections 2251. The first and second support sections 2241, 2251 are connected to the inner wall of the inclined frame body assembly 21. The structure and configuration of the first and second support sections 2241, 2251 can be designed as static blade wing-shaped structures (as shown in FIG. 2) or rib structures (not shown) according to the requirement of a user. This will not affect the effect achieved by the present invention.

The inclined frame body assembly 21 has a horizontal axis L1. The horizontal axis L1 and the outer wall of the inclined frame body assembly 21 contain a first angle $\alpha$. The inclined frame body assembly 21 has a first vertical axis L2. The first vertical axis L2 and the first base seat 224 contain a second angle $\beta$. The inclined frame body assembly 21 further has a second vertical axis L3. The second vertical axis L3 and the second base seat 225 contain a third angle $\gamma$. The first, second and third angles $\alpha$, $\beta$, $\gamma$ are not specifically limited and are determined by the inclination of the inclined frame body assembly 21 and the inclinations of the first and second base seats 224, 225 obliquely disposed in the first and second spaces 221, 222.

The first rotor assembly 23 is correspondingly disposed on the first base seat 224. The first rotor assembly 23 has a first shaft 232 and multiple first blades 233. One end of the first shaft 232 is rotatably disposed on the first base seat 224. The first rotor assembly 23 further has a first receiving section 231 for receiving therein a first stator assembly 25.

The second rotor assembly 24 is correspondingly disposed on the second base seat 225. The second rotor assembly 24 has a second shaft 242 and multiple second blades 243. One end of the second shaft 242 is rotatably disposed on the second base seat 225. The second rotor assembly 24 further has a second receiving section 241 for receiving therein a second stator assembly 26.

Please further refer to FIGS. 2 and 3. In this embodiment, the inclined frame body assembly 21 further has a first support frame 226 and a second support frame 227. The first support frame 226 and the first base seat 224 are integrally formed. The second support frame 227 and the second base seat 225 are integrally formed. The first and second support frames 226, 227 are assembled by means of insertion, locking, adhesion, engagement or latching. The first support frame 226 has a first air inlet 2261 and a first air outlet 2262. The first air inlet 2261 and the first air outlet 2262 communicate with the first space 221. The second support frame 227 has a second air inlet 2271 and a second air outlet 2272. The second air inlet 2271 and the second air outlet 2272 communicate with the second space 222.

Figure 5:
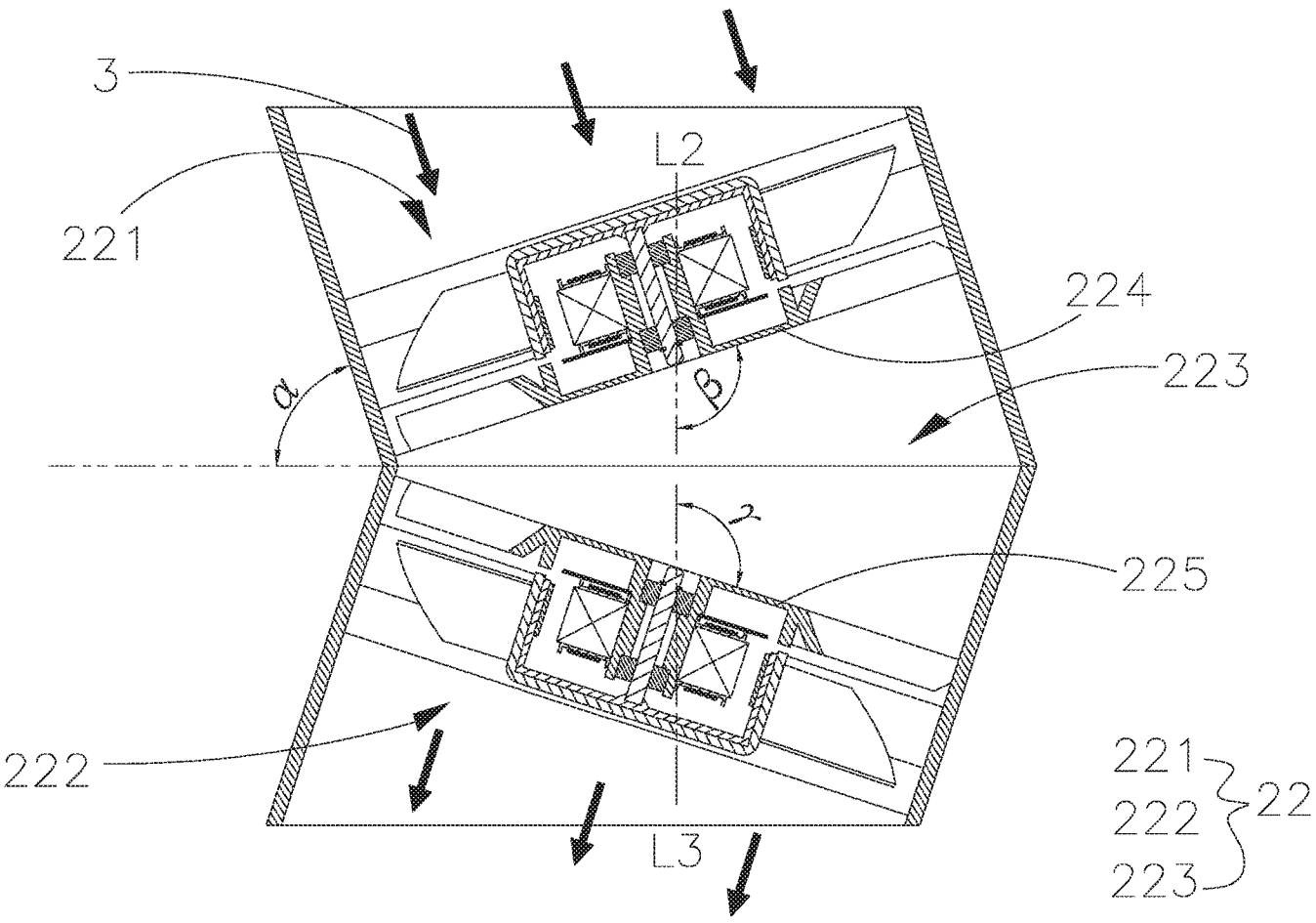
FIG. 5 is a sectional view of a second embodiment of the series fan inclination structure of the present invention.

According to the structural design of the present invention, in use, the first air outlet 2262 of the first support frame 226 is correspondingly mated and connected with the second air inlet 2271 of the second support frame 227. (Alternatively, as shown in FIG. 5, in a second embodiment, the first air outlet 2262 of the first support frame 226 is correspondingly mated and connected with the second air outlet 2272 of the second support frame 227). The inclined frame body assembly 21 has an inclined configuration and the first and second base seats 224, 225 are obliquely disposed on the inner wall of the inclined frame body assembly 21, (that is, the first and second base seats 224, 225 and the first and second vertical axes L2, L3 contain the second and third angles $\beta$ and $\gamma$ as shown in FIGS. 4 and 5). Therefore, the first and second rotor assemblies 23, 24 are also disposed on the first and second base seats 224, 225 in a state inclined from the horizontal axis L1. Accordingly, the entire series fan has an inclined structure. In this case, after the airflow 3 flows into the first space 221 from the first air inlet 2261, the airflow 3 will flow through the flow guide passage 223 and the first air outlet 2262 and then flow into the second air inlet 2271 and the second space 222. Finally, the airflow 3 flows out from the second air outlet 2272. Accordingly, the flow direction and pattern of the airflow 3 entering the series fan structure are changed and the development of audio frequency of the dipole is destructed. This solves the problem of the conventional series fan that when multiple series fans are combined in parallel and co-used, the pairs of fans will interact on each other to synergize the development of the noise dipole and cause great vibration and make loud noise. Therefore, the present invention can be greatly lower the noise.

Figure 6:
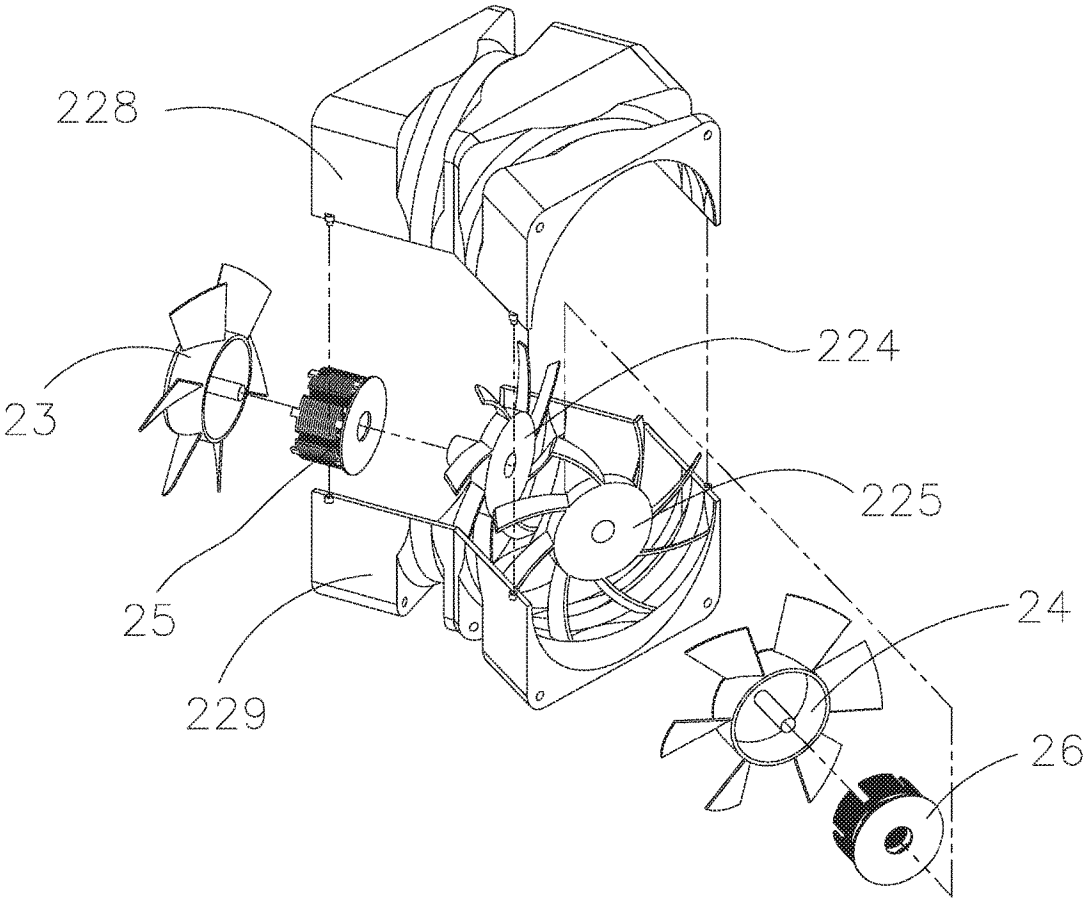
FIG. 6 is a perspective exploded view of a third embodiment of the series fan inclination structure of the present invention.
Figure 7:
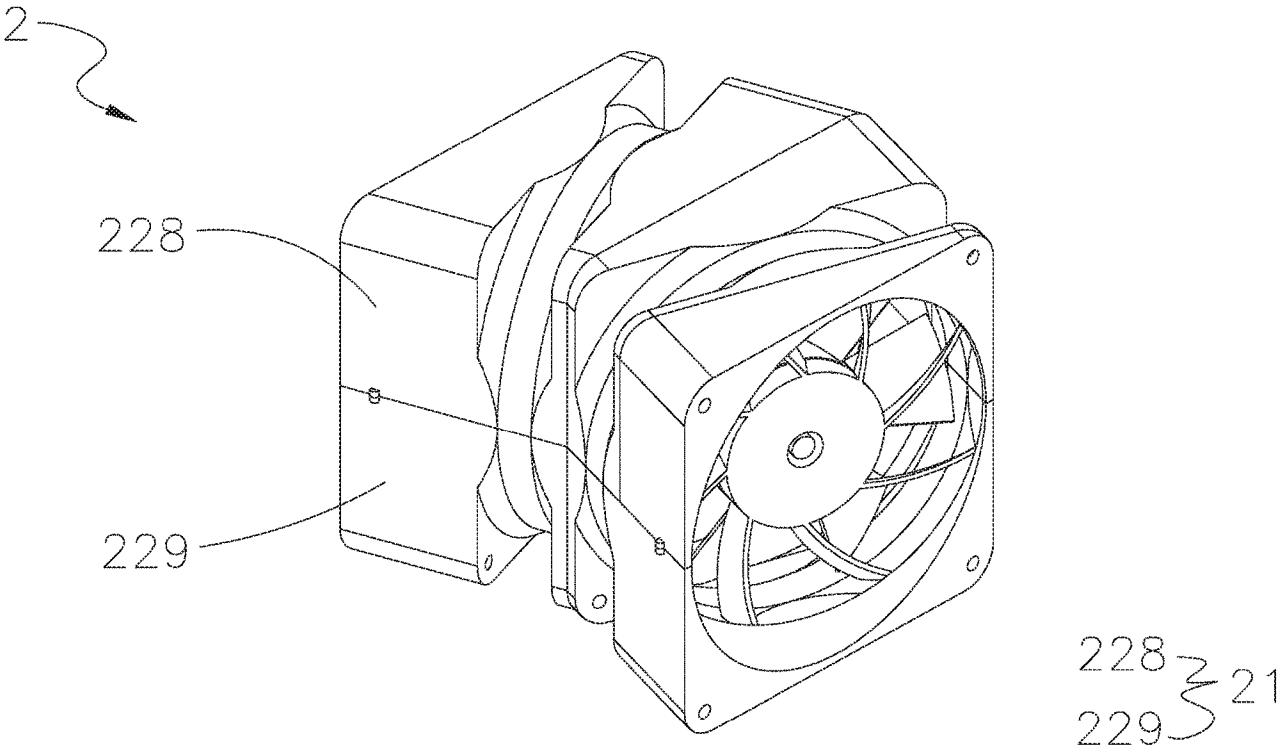
FIG. 7 is a perspective assembled view of the third embodiment of the series fan inclination structure of the present invention.

Please now refer to FIGS. 6 and 7. FIG. 6 is a perspective exploded view of a third embodiment of the series fan inclination structure of the present invention. FIG. 7 is a perspective assembled view of the third embodiment of the series fan inclination structure of the present invention. The third embodiment is partially identical to the first embodiment in component and relationship between the components and thus will not be repeatedly described hereinafter. The third embodiment is mainly different from the first embodiment in that in this embodiment, the inclined frame body assembly 21 has another form. The inclined frame body assembly 21 has an upper support frame 228 and a lower support frame 229. In this embodiment, the lower support frame 229 and the first and second base seats 224, 225 are, but not limited to, integrally formed. In practice, alternatively, the upper support frame 228 and the first and second base seats 224, 225 are integrally formed (not shown). The upper and lower support frames 228, 229 are assembled by means of insertion, locking, adhesion, engagement or latching. The structural design of this embodiment can also achieve the same effect as the above embodiment.

Figure 8:
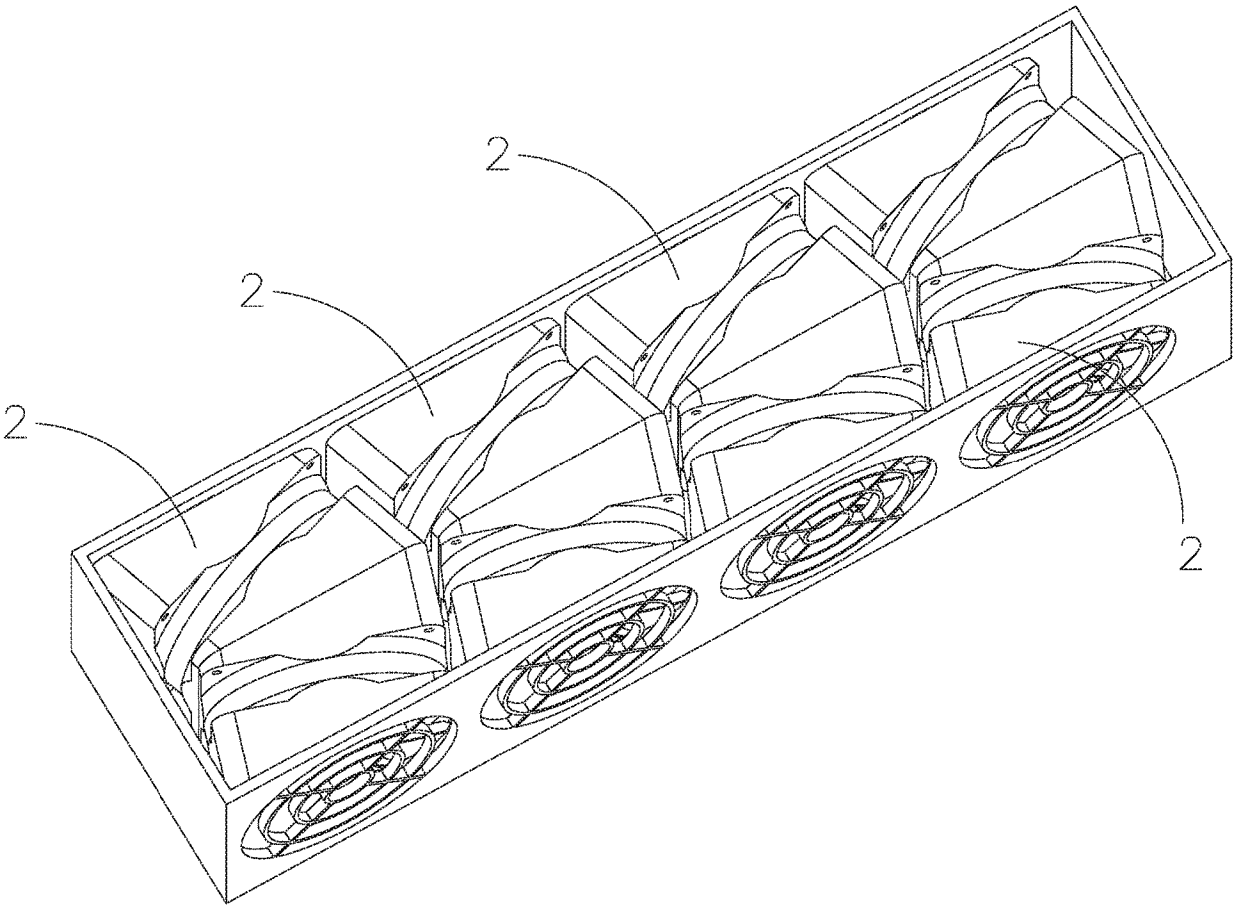
FIG. 8 is a perspective assembled view of a fourth embodiment of the series fan inclination structure of the present invention.
Figure 9:
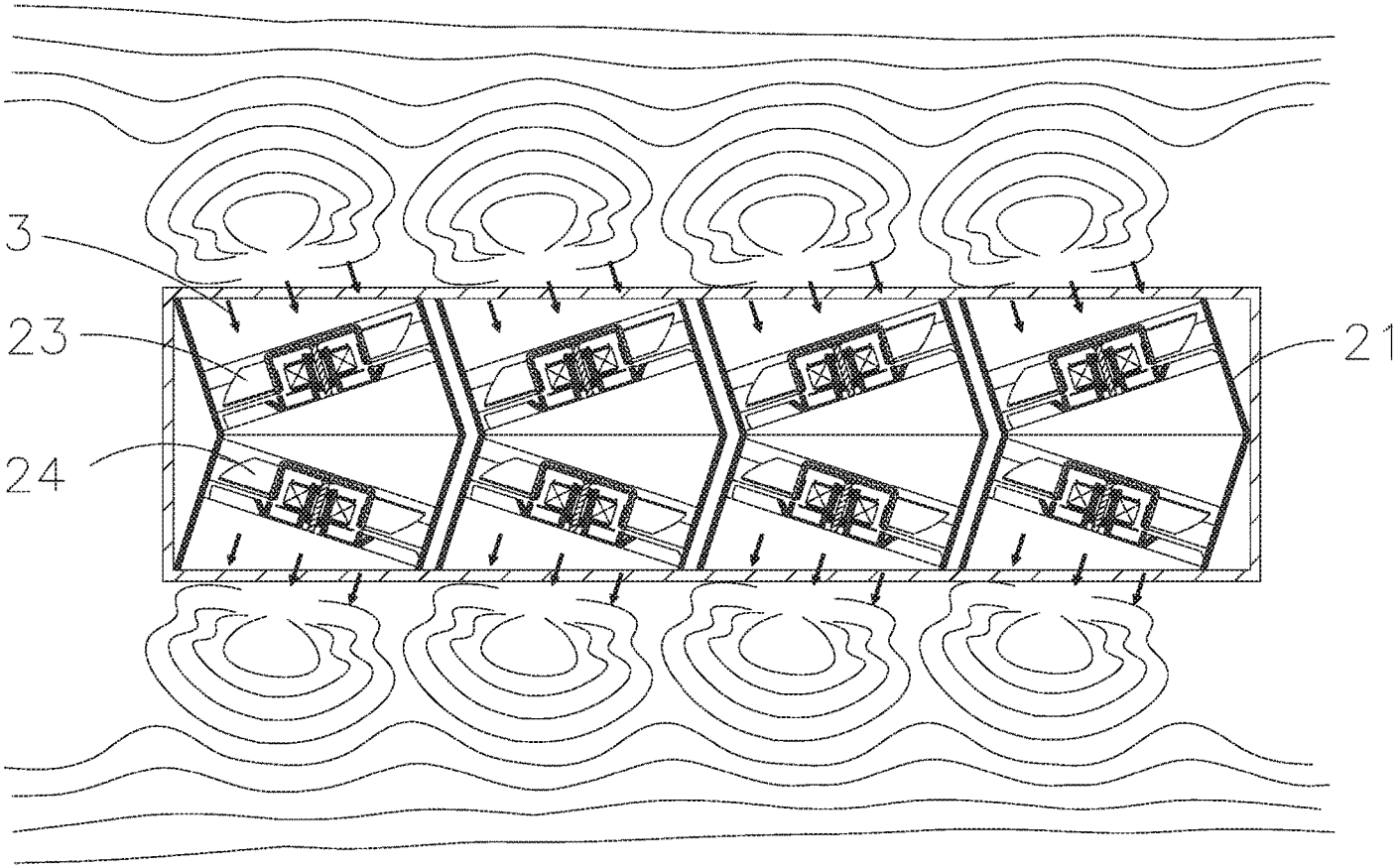
FIG. 9 is a sectional assembled view of the fourth embodiment of the series fan inclination structure of the present invention.

Finally, please refer to FIGS. 8 and 9. FIG. 8 is a perspective assembled view of a fourth embodiment of the series fan inclination structure of the present invention. FIG. 9 is a sectional assembled view of the fourth embodiment of the series fan inclination structure of the present invention. The fourth embodiment is partially identical to the first embodiment in component and relationship between the components and thus will not be repeatedly described hereinafter. The fourth embodiment is mainly different from the first embodiment in that multiple inclined frame body assemblies 21 are further combined in parallel and co-used. The inclined frame body assemblies 21 are applicable to a large-scale apparatus for dissipating the heat thereof. This solves the problem of the conventional series fan that when multiple series fans are combined in parallel and co-used, the pairs of fans will interact on each other to synergize the development of the noise dipole and cause great vibration and make loud noise. Therefore, the present invention can greatly lower the noise.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A non-coaxial series fan structure comprising:

an inclined fan frame body assembly having a receiving space including:

a first rotor space, a second rotor space, a flow guide passage, a first base seat obliquely disposed in the first rotor space and having multiple first support sections, and a second base seat obliquely disposed in the second rotor space and having multiple second support sections, the first and second support sections being connected to an inner wall of the inclined fan frame body assembly and the first and the second support sections each configured as static inclined blade structures, the flow guide passage being formed between the first and second base seats in communication with the first and second rotor spaces;

a first rotor assembly disposed on the first base seat; and a second rotor assembly disposed on the second base seat, wherein the first and second rotor assemblies are disposed in a non-coaxial, series arrangement such that the first rotor assembly drives an airflow to pass through the second rotor assembly, a flow direction and pattern of the airflow entering the non-coaxial series fan structure changing therein so as to destroy development of an audio frequency dipole.

2. The non-coaxial series fan structure as claimed in claim 1, wherein the inclined fan frame body assembly has a horizontal axis, the horizontal axis and outer wall of the inclined frame body assembly containing a first angle.

3. The non-coaxial series fan structure as claimed in claim 1, wherein the inclined fan frame body assembly has a first vertical axis, the first vertical axis and the first base seat containing a second angle.

4. The non-coaxial series fan structure as claimed in claim 1, wherein the inclined fan frame body assembly has a second vertical axis, the second vertical axis and the second base seat containing a third angle.

5. The non-coaxial series fan structure as claimed in claim 1, wherein the inclined fan frame body assembly further has a first support frame and a second support frame, the first support frame and the first base seat being integrally formed, the second support frame and the second base seat being integrally formed.

6. The non-coaxial series fan structure as claimed in claim 5, wherein the first and second support frames are assembled by insertion, locking, adhesion, engagement or latching.

7. The non-coaxial series fan structure as claimed in claim 5, wherein the first support frame has a first air inlet and a first air outlet, the first air inlet and the first air outlet communicating with the first space, the second support frame having a second air inlet and a second air outlet, the second air inlet and the second air outlet communicating with the second space.

8. The non-coaxial series fan structure as claimed in claim 1, wherein the inclined fan frame body assembly has an upper support frame and a lower support frame, the lower support frame and the first and second base seats integrally formed.

9. The non-coaxial series fan structure as claimed in claim 8, wherein the upper and lower support frames are assembled by insertion, locking, adhesion, engagement or latching.

10. The non-coaxial series fan structure as claimed in claim 1, wherein the first rotor assembly has a first receiving section for receiving therein a first stator assembly and the second rotor assembly has a second receiving section for receiving therein a second stator assembly.

* * * * *